United States Patent [19]

Divisek et al.

[11] Patent Number: 4,584,065

[45] Date of Patent: Apr. 22, 1986

[54] ACTIVATED ELECTRODES

[75] Inventors: Jiri Divisek; Heinz Schmitz, both of Jülich; Heinz Wüllenweber, Frankfurt, all of Fed. Rep. of Germany

[73] Assignees: Kernforschungsanlage Jülich GmbH, Jülich; Metallgesellschaft AG, Frankfurt, both of Fed. Rep. of Germany

[21] Appl. No.: 644,829

[22] Filed: Aug. 27, 1984

[30] Foreign Application Priority Data

Aug. 27, 1983 [DE] Fed. Rep. of Germany ..... 3330961

[51] Int. Cl.[4] ..... C25D 1/08; C25D 1/20; C25D 5/48

[52] U.S. Cl. ..... 204/11; 204/24; 204/35.1

[58] Field of Search ..... 204/3, 4, 11, 13, 24, 204/141.5, 146, 12, 35.1

[56] References Cited

U.S. PATENT DOCUMENTS

| | | | |
|---|---|---|---|
| 1,071,036 | 8/1913 | Feldkamp | 204/13 |
| 1,709,801 | 4/1929 | Müller | 204/12 |
| 3,097,149 | 7/1963 | Tacroix | 204/141.5 |
| 3,272,728 | 9/1966 | Hahndorff et al. | 204/35 |
| 3,594,292 | 7/1971 | Russell | 204/129.95 |
| 4,104,133 | 8/1978 | Brannan | 204/35.1 |
| 4,108,737 | 8/1978 | Ehrhardt | 204/13 |
| 4,221,643 | 9/1980 | Miles | 204/35.1 |
| 4,250,004 | 2/1981 | Miles et al. | 204/98 |
| 4,300,993 | 11/1981 | Divisek | 204/35.1 |
| 4,331,517 | 5/1982 | Rechlicz | 204/35.1 |
| 4,432,839 | 2/1984 | Kline | 204/12 |

OTHER PUBLICATIONS

M. L. Block and R. Clark, "Metal Foil Preparative Method"—IBM Technical Disclosure Bulletin, vol. 25, No. 3A, Aug. 1982.

*Primary Examiner*—T. M. Tufariello
*Attorney, Agent, or Firm*—Nils H. Ljungman

[57] ABSTRACT

A process for the manufacture of thin activated electrodes including a base metal, which can be iron, cobalt or nickel, with a good adhering active surface layer. Both the base metal and the surface layer are galvanically sequentially deposited as separate layers on a removable electrically-conductive carrier. The surface layer is deposited as an activatable alloy including the base metal and a leachable metal, particularly zinc. The galvanizing deposited layers are subsequently separated as a unit from the carrier. The alloy is activated by leaching the leachable metal therefrom before, during or after separation of the carrier. Two activatable layers of alloy can be deposited on the carrier with a layer of the base metal deposited between the alloy layers.

30 Claims, 2 Drawing Figures

ACTIVATED ELECTRODES

BACKGROUND OF THE INVENTION

1. Field of the Invention

This invention relates to a process for the manufacture of electrodes comprising a layer of activated metal such as Raney nickel deposited on a base metal such as iron, cobalt or nickel and to the electrodes manufactured by the process.

2. Description of the Prior Art

Some industrial electrolysis processes, such as alkaline electrolysis of water or chloro-alkali electrolysis, require as a cathode an electrode with low hydrogen overvoltage. In addition, for alkaline electrolysis of water an anode is desirable which allows oxygen generation without overvoltage. For this reason, catalytic-acting electrodes are used.

The best-known catalyst for hydrogen generation is platinum. However, because of its high price only very thin platinum coatings are deposited on the electrodes, which are typically less than 1 mg Pt/cm$^2$, so that the efficiency of the electrodes is not entirely satisfactory. As demonstrated by comparative tests conducted by Teledyne Energy Systems (Hydrogen Energy Progress-IV, Editors T. N. Veziroglu, W. D. Van Vorst, J. H. Kelley, Pergamon Press, Oxford, 1982, pages 151–158), catalysts based on non-noble metals are overall more favorable.

One example investigated by Teledyne was a nickel/-molybdenum catalyst developed by the BP Research Centre in Middlesex (EP Patent Application No. 79 301 963.9). Nickel boride catalysts (DE-PS No. No. 2 307 852) were also tested, which yielded higher hydrogen overvoltages than platinum coatings (Hydrogen Energy Progress III, Editors T. N. Veziroglu, K. Fueki, T. Ohta, Pergamon Press, Oxford, 1981, pages 15–27). Other known catalysts include nickel sulfide (BE-PS No. 864 275) and various coatings with mixed transition metal oxides (Seminar on Hydrogen as an Energy Vector, EEC Report EUR No. 6085, 1978, pages 166–180) or transition metals (GB No. 1 510 099 and U.S. Pat. No. 4,152,240).

Hydrogen overvoltage is effectively reduced by the use of Raney nickel electrodes (E. Justi, A. Winsel, "Cold Combustion, Fuel Cells", Franz Steiner Verlag, Mainz, 1962). However, these electrodes, originally produced using a molding process, can only be manufactured in customary industrial sizes uneconomically and with difficulty. Therefore, an improved rolling process was developed by Lurgi (J. Mueller, K. Lohrberg, H. Wuellenweber, Chem.-Ing.-Techn. 52 (1980) pages 435–436), which makes possible a simple enlargement of the working surface of the electrodes. According to this process, nickel or steel sheet is clad with Raney nickel powder, and activated in the customary manner by treatment with KOH. In addition to a low overvoltage, the excellent long-term behavior of electrodes produced in this manner is remarkable. After an operating time of one year at a current density of 2 kA/m$^2$ and an operating temperature of 92° C., the electrode potential was unchanged.

Similar long-term behavior is also exhibited by electrodes coated with Raney nickel, which can be obtained exceptionally easily be activation of a galvanically-deposited Ni/Zn layer (J. Divisek, H. Schmitz, J. Mergel: Chem-Ing.-Techn. 52 (1980), page 465). See also German Pat. No. 1 294 943 which shows that from a solution containing $Ni^{2+}$ and $Zn^{2+}$ ions, a Ni/Zn alloy is galvanically deposited on a electrode matrix and is then activated in the customary manner to Raney nickel with an alkali solution.

The electrode obtained in this manner can be used as a cathode in alkaline generation of hydrogen or as a cathode and/or anode in alkaline electrolysis of water. The matrix used must have a good electrical conductivity and can have various geometric shapes, so that there is no "a priori" limitation on the design of an electrolyzer. Preferred geometric shapes of such an electrode matrix are wire meshes, metal meshes or perforated sheets. The last-named form is especially important, since it makes possible the so-called "sandwich" construction of an electrolysis cell for alkaline electrolysis of water, in which the two electrodes are directly in contact with the gas separator (diaphragm, ion conductor) with "zero distance" between them, so that the distances between electrodes are minimized and the ohmic voltage drops become negligible.

3. Problems of the Prior Art

Certain problems occur in the activation of thin nickel electrodes, specifically with perforated sheets. Usable depositions of Raney alloys, especially of Ni/Zn alloys from an electrolyte containing $Ni^{2+}$ and $Zn^{2+}$ ions, require cathode current densities of 4–7 A/dm$^2$, or more. At the same time, the potential over the total surface area of the electrode matrix to be coated with the activatable alloy must be as uniform as possible, i.e. for a uniform, controlled deposition, the potential differences within the cathode caused by the ohmic voltage drop may not exceed 40 mV. However, such potential differences do occur within the cathode surface with low sheet thicknesses of the electrode matrix of about 0.2–0.5 mm, such as those which are preferred for alkaline electrolysis of water, on account of the lower price and technological advantages over sheet thicknesses of 1 mm and more.

Thus, for example, during the galvanic Ni/Zn coating of an industrial-size electrode matrix for alkaline electrolysis of water of 2–4 m$^2$, electrical currents are on the order of 1000–3000 A during the galvanic deposition. With such current strengths, in order to be able to conduct the galvanic deposition with a potential difference in the electrode of less than 40 mV, the Ohmic resistance in the sheet must be kept correspondingly low. For this purpose, either the sheet thickness of the electrodes must be increased, which entails considerable technological disadvantages and increased costs, or the current path through the electrodes must be kept correspondingly short during the galvanic deposition. With larger electrode surfaces, that can only be done by means of a number of contact points or lines. Only then does the galvanic deposition become uniform and reproducible and can, by subsequent treatment with KOH, be converted into an activated electrode layer (Raney nickel layer) for chloro-alkali electrolysis or alkaline electrolysis of water.

Moreover, inside the electrolyzer for alkaline electrolysis multiple contacts over the electrode surface are also required. As a rule these contacts are not the same as the ones described above, so that the contacts used for the coating must be removed once again and new ones applied. Defects thereby occur on the surface of the electrodes, which interfere with uniformity and therefore power. If, on the other hand, during the galvanic deposition of the nickel alloy, pressure contacts are provided for the current distribution, then uncoated areas occur at the pressure points, which subsequently also interfere with the electrolysis.

Therefore, a uniform defect-free and controlled galvanic Ni/Zn coating of thin electrodes with industrial dimensions can not be achieved in the customary manner. The same is true for electrodes based on Co and Fe, which are activated by coating with an alloy of electrode base metal and metal which can be leached by a leaching treatment, such as tin or zinc, and a subsequent leaching of these components.

SUMMARY OF THE INVENTION

The present invention provides a process by means of which even the thinest electrodes can be manufactured in a simple manner with a catalytically-active coating.

According to the present process, both the base metal and the activatable alloy of the base metal with a metal which can be leached by a leaching treatment, especially zinc, required for the formation of the active layer(s) are deposited one after another on a removable, electrically-conducting carrier in the sequence necessary for the electrode to be manufactured, and the activatable alloy is activated by leaching before, during or preferably after the removal of the carrier.

The galvanic production of electrode sheets and also the activation of such sheets by the galvanic deposition of activatable alloys followed by leaching is known. However, heretofore the two steps (sheet production and galvanic deposition of activatable alloys) have been performed separately, i.e. the sheet, previously manufactured, is galvanically provided with the activatable alloy in a separate process. This method has the abovementioned disadvantages, especially in the manufacture of thin electrodes, whereby additional problems can occur involving the adherence of the alloy layer to the electrode sheet on account of surface changes which are difficult to measure caused by drying, storage, shipment and handling of the sheets.

According to the invention, the electrode base metal, preferably pure nickel, is galvanically deposited as the carrier core layer and activatable alloy, especially Ni/Zn alloy (with uniform or changing Zn concentration) is separately galvanically deposited. The deposits occur in an appropriate sequence on a substrate which is a good electrical conductor. Removable carriers for the galvanic production of sheets and components are known.

For the production of a bilaterally active electrode, an activatable alloy (e.g. NiZn) is first deposited on a carrier followed by the deposition of pure base metal (e.g. nickel), after which another activatable alloy layer (e.g. NiZn again) is deposited. However, only unilaterally-activatable double layers can be produced or powder, e.g. nickel powder, can be deposited together with the base metal, which leads to a roughening of the core layer.

The activation of the alloy layer is accomplished in the customary manner by means of a leaching treatment, which can be carried out before the removal of the multi-layer deposit from the carrier, or simultaneously with it. Preferably, however, the galvanic deposit is first removed from the carrier and then activated by the leaching treatment.

According to the invention, self-supporting activated electrodes are obtained with a thickness of less than 1 mm by means of a rapid process in which the layers are deposited with a current strength of approximately 10–20 A/dm$^2$.

The thickness of the core layer can be about 0.1 to about 0.5 mm and, preferably, between about 0.1 and about 0.3 mm. The thickness of the activatable alloys is about 10 to about 100 microns.

The core layer (as well as the activation layers) are produced in the desired form, e.g. continuous or perforated plate, etc., which is possible with the use of photosensitive or a photo resist technique, like that used in the production of printed circuits or by a grooved roller technique.

The electrode layers to be activated can also be provided with a "hole pattern" which differs from the core layer, so that the finished electrode exhibits bright metallic regions, by means of which the electrodes can be equipped with pressure contacts. Thus, for example, the first activatable layer formed on the removable substrate can be formed with a hole pattern corresponding to the subsequent contact points of the electrode on a substrate, such as a warted or nipple plate after which the core layer is deposited, including these regions. Such a hole pattern formation only in the activation layer can be achieved by known technology by means of two-layer photo masks or two one-layer masks. On such metallically bright places of the activated electrode, the transition resistance with a spring contact of the electrodes with a metallically-conducting "substrate" is practically negligible.

EXAMPLE 1

On a cathodically polarized substrate of polished stainless steel, a layer 50 microns thick of Ni/Zn alloy (ratio of Ni/Zn by weight 60:40) was first galvanically deposited. The electrolyte contained $NiCl_2$, $ZnCl_2$ and $H_3BO_3$. Electrolysis was carried out at 60° C. with a cathodic current density of 5 A/dm$^2$. Then, a 150 mircon thick layer of pure nickel was deposited. Electrolysis was conducted with a current density of 5 A/dm$^2$ and a bath temperature of 50° C. in an electrolyte which contained $NiSO_4$, NaCl and $H_3BO_3$. Then, a third 50 micron thick Ni/Zn layer of the same composition as the first layer was galvanically deposited.

Figure 1:
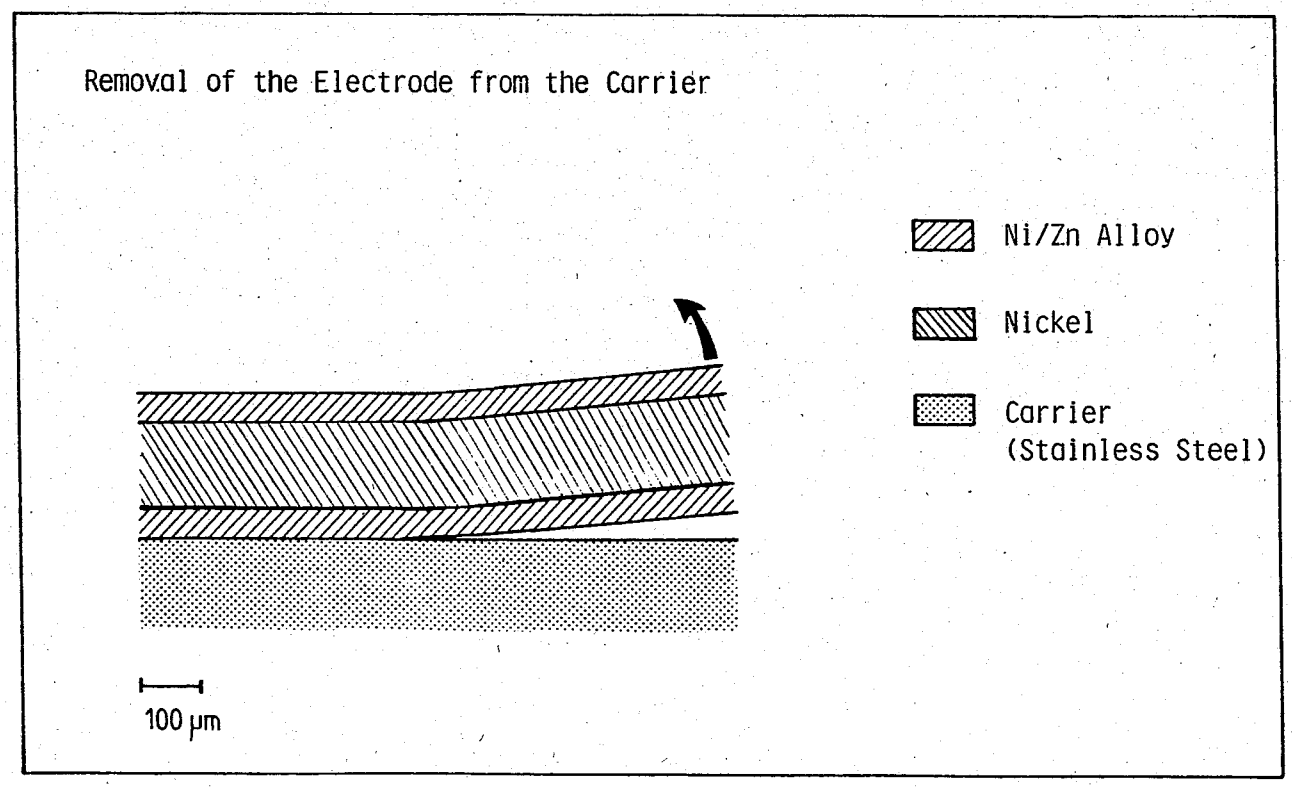
FIG. 1 diagrammatically illustrates the method for preparing the electrode of this invention.

The sheet of three layers which was formed in this manner was mechanically removed from the stainless steel electrode (FIG. 1) and then treated with hot aqueous KOH solution, so that Zn was dissolved and a porous nickel layer remained behind. In this manner, an electrode catalytically coated on both sides with Raney nickel was obtained, which was used as anode and cathode for an alkaline electrolysis of water: In 10 M KOH, at 100° C. and a current density of 200 mA/cm$^2$, the following potential values were measured, by comparison with an HgO reference electrode:

Cathodic: −1005 mV

Anodic: +490 mV

The sum of both potentials is 1495 mV. Electrolysis of water with these electrodes and an NiO diaphragm worked at a cell voltage of 1.53 V. Both are extraordinarily good characteristics.

EXAMPLE 2

On a polished stainless steel substrate, a resist mask was produced photographically according to the customary printed-circuit technology, the pattern of which made possible the galvanic deposition of a perforated sheet (hole diameter 4 mm, exposed surface 41%). As in Example 1, three layers were again galvanically deposited (first Ni/Zn, second Ni, third Ni/Zn), and the perforated plate formed in this manner was mechanically separated from the stainless steel substrate and activated with KOH.

Figure 2:
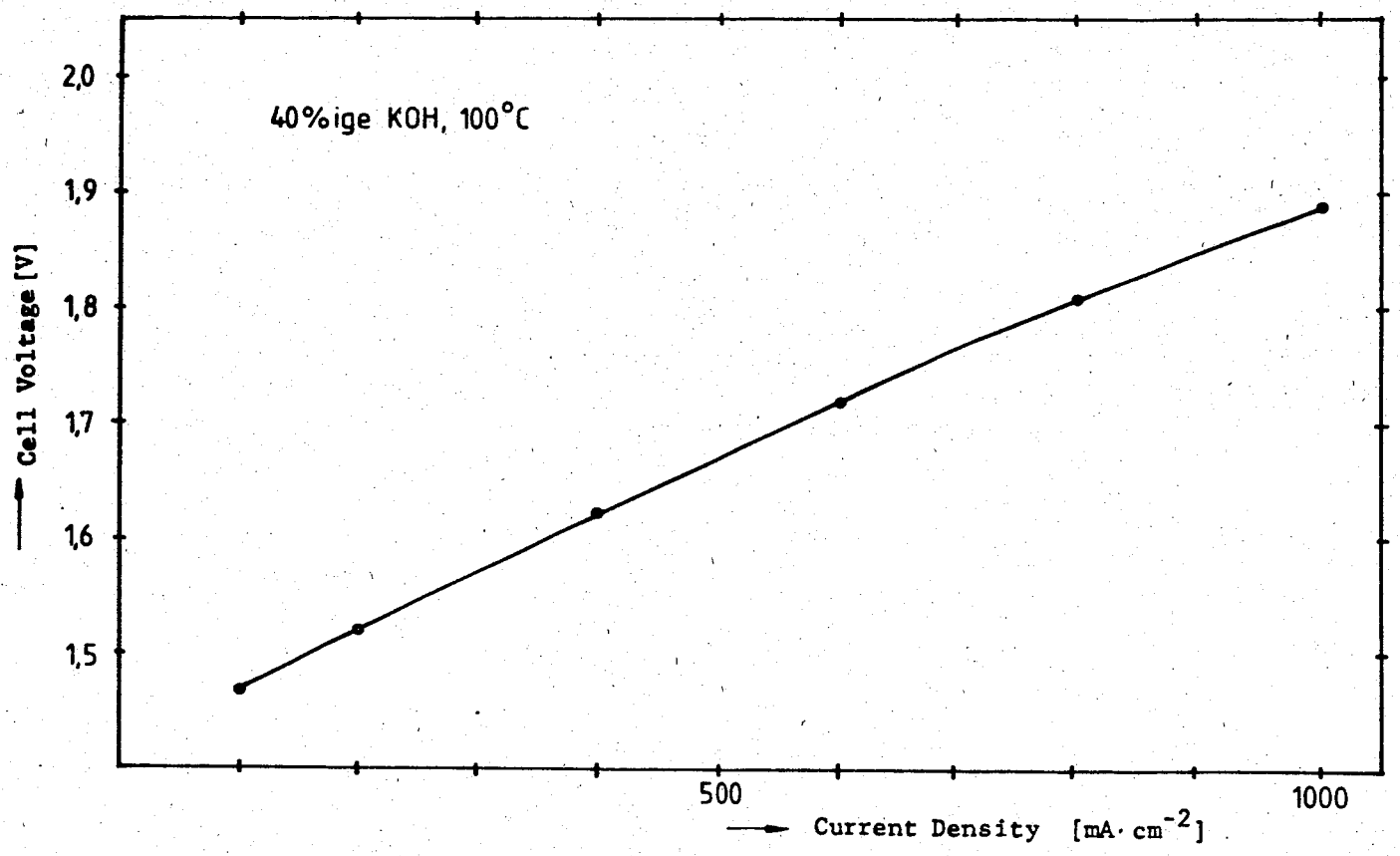
FIG. 2 presents a current density-voltage curve in an electrolysis operation using an electrode of this invention.

The active electrodes obtained were installed together with an NiO diaphragm in an electrolysis cell for alkaline electrolysis of water, and the electrolysis was carried out. In KOH solution at 100° C. and 200 $mA/cm^2$, a cell voltage of 1.52 V was measured. The entire current/voltage curve is shown in FIG. 2.

The above two examples clearly show that by means of the invention active electrodes for alkaline electrolysis can be obtained in a very simple manner. The coating and electrode shapes can be easily specified and varied, like those for printed circuits.

The electrodes manufactured in accordance with the invention are characterized not only by their high efficiency, but also by the ease of their manufacture and low consumption of material, and they are therefore very economical. Moreover, very thin, active electrodes with a large surface area can be manufactured galvanically free of defects only in this manner. Thus, starting from a thin nickel sheet of perhaps 150 μm in the conventional manner, it is not possible to obtain uniformly and controlled activated surface layers by galvanic deposition of Ni/Zn and subsequent leaching because of the above described contacting problems.

EXAMPLE 3

The process described in Example 1 was repeated, but the nickel layer was deposited from an electrolyte with carbon nickel powder stirred up in it, so that powder particles were galvanically fixed together with the nickel layer which formed. In this manner, a roughening is built into the intermediate nickel layer. This is useful for many purposes, such as to reduce potential differences by increasing the geometric surface. The electrodes also exhibits, after the activation, the same excellent properties during electrolysis of water as the electrode in Example 1.

Of course, electrodes can also be manufactured which are based only on two layers (a Ni layer and an activatable Ni—Zn alloy layer). In the precipitation of the alloy, moreover, by variation of the current density, a changing Ni:Zn ratio can be formed and in this manner not only three discrete layers but a multi-layer material can be produced. This latter process may be advantageous for certain specific applications.

We claim:

1. A process for the manufacture of an activated electrode comprising galvanically sequentially depositing on a removable electrically-conducting carrier a base metal and an alloy containing said metal with a leachable metal, removing said carrier and leaching said leachable metal to provide an active coating metal.

2. A process for the manufacture of an activated electrode comprising galvanically sequentially depositing on a removable electrically-conducting carrier a base metal and an alloy containing said base metal with a leachable metal, leaching said leachable metal to provide an active coating metal and removing said carrier.

3. The process of claim 1 wherein said base metal is a metal selected from the group consisting of iron, cobalt and nickel.

4. The process of claim 2 wherein said base metal is a metal selected from the group consisting of iron, cobalt and nickel.

5. The process of claim 1 wherein said base metal is nickel.

6. The process of claim 2 wherein said base metal is nickel.

7. The process of claim 1 wherein said leachable metal is zinc.

8. The process of claim 2 wherein said leachable metal is zinc.

9. The process of claim 1 wherein said active coating metal is Raney nickel.

10. The process of claim 2 wherein said active coating metal is Raney nickel.

11. The process of claim 1 including the step of applying to said removable electrically conducting carrier an isolation varnish pattern corresponding to a desired electrode pattern in advance of the galvanic sequential depositing steps.

12. The process of claim 2 including the step of applying to said removable electrically conducting carrier an isolation varnish pattern corresponding to a desired electrode pattern in advance of the galvanic sequential depositing steps.

13. The process of claim 1 including more than one galvanic sequential depositions of said alloy with said base metal deposited in between.

14. The process of claim 2 including more than one galvanic sequential depositions of said alloy with said base metal deposited in between.

15. The process of claim 1 with more than one galvanic sequential deposition of base metal preceded and followed by galvanic deposition of said alloy.

16. The process of claim 2 with more than one galvanic sequential deposition of base metal preceded and followed by galvanic deposition of alloy.

17. The process of claim 1 wherein a leach-resistant metal powder is galvanically fixed together with the base metal.

18. The process of claim 2 wherein a leach-resistant metal powder is galvanically fixed together with the base metal.

19. The process of claim 17 wherein said metal powder is nickel powder.

20. The process of claim 18 wherein said metal powder is nickel powder.

21. The process of claim 1 wherein the alloy is deposited with a pattern of holes for the subsequent pressure contact of the electrode with exposed base metal.

22. The process of claim 2 wherein the alloy is deposited with a pattern of holes for the subsequent pressure contact of the electrode with exposed base metal.

23. The process of claim 1 wherein the alloy is deposited in a thickness of about 10 to about 100 microns and the base metal is deposited in a thickness of about 0.1 to about 0.5 mm.

24. The process of claim 23 wherein the base metal is deposited with a thickness of about 0.1 to about 0.3 mm.

25. The process of claim 2 wherein the alloy is deposited in a thickness of about 10 to about 100 microns and the base metal is deposited in a thickness of about 0.1 to about 0.5 mm.

26. The process of claim 25 wherein the base metal is deposited in a thickness of about 0.1 to abut 0.3 mm.

27. The process of claim 1 wherein the galvanic depositions are conducted with a current density of about 10 to about 20 A/dm$^2$.

28. The process of claim 2 wherein the galvanic depositions are conducted with a current density of about 0 to about 20 A/dm$^2$.

29. An activated electrode with a thickness of less than about 1 mm prepared by the process of claim 1.

30. An activated electrode with a thickness of less than about 1 mm prepared by the process of claim 2.

* * * * *